US005444875A

United States Patent [19]

Taniuchi

[11] Patent Number: 5,444,875

[45] Date of Patent: Aug. 29, 1995

[54] HELMET FOR RIDING VEHICLE

[75] Inventor: Fujio Taniuchi, Tokyo, Japan

[73] Assignee: Shoei Kako Kabushiki Kaisha, Tokyo, Japan

[21] Appl. No.: 177,939

[22] Filed: Jan. 6, 1994

[30] Foreign Application Priority Data

Jul. 19, 1993 [JP] Japan ..... 5-178304

[51] Int. Cl.[6] ..... A42B 1/08

[52] U.S. Cl. ..... 2/424

[58] Field of Search ..... 2/410, 421, 422, 423, 2/424, 425, 6.2, 6.3, 6.4, 6.5, 9, 10, 15

[56] References Cited

U.S. PATENT DOCUMENTS

| | | | |
|---|---|---|---|
| 4,769,857 | 9/1988 | Cianfanelli et al. | 2/421 X |
| 4,794,652 | 1/1989 | Piech von Planta et al. | 2/424 X |
| 5,084,918 | 2/1992 | Breining et al. | 2/424 |
| 5,185,889 | 2/1993 | Kamata | 2/424 |
| 5,301,372 | 4/1994 | Mataba | 2/424 |

FOREIGN PATENT DOCUMENTS

| | | | |
|---|---|---|---|
| 515753 | 12/1992 | European Pat. Off. | 2/424 |
| 2339353 | 9/1977 | France | 2/424 |
| 4040172 | 6/1992 | Germany | 2/421 |

*Primary Examiner*—Clifford D. Crowder
*Assistant Examiner*—Michael A. Neas
*Attorney, Agent, or Firm*—Armstrong, Westerman, Hattori, McLeland and Naughton

[57] ABSTRACT

A helmet has both functions of a cap body of the full face type for protecting a wide area and a cap body of the jet type for exposing a large window opening. An auxiliary cap body is mounted on left and right opposite sidewalls of a main cap body of the jet type having the large window opening for turning between a lowered position in which the auxiliary cap body covers a lower half of the large window opening, and a lifted position in which the entire large window opening is exposed. And a lock mechanism is provided for automatically locking the auxiliary cap body to the main cap body in the lowered position of the auxiliary cap body. Thus, when the helmet is brought into the full face type state, the locking of the auxiliary cap body to the main cap body can reliably and easily be achieved.

7 Claims, 13 Drawing Sheets

HELMET FOR RIDING VEHICLE

BACKGROUND OF THE INVENTION

1. Field of the Invention

The present invention relates to a helmet to be used by an occupant riding on a vehicle such as a motorcycle and a racing car.

2. Description of the Prior Art

A cap body of a helmet for riding a vehicle widely used in recent years is classified in two types: a full face type having a chin covering portion for covering a user's chin; and a jet type having no chin covering portion in order to expose the whole of a user's face.

The cap body of the full face type can have a wide protection area by the presence of the chin covering portion, but, when a user intends to have a smoke or to eat and drink, the chin covering portion is an obstruction. For this reason, it is necessary to remove the helmet at each time. This is troublesome. The cap body of the jet type can have only a reduced protection area due to the absence of the chin covering portion, but it is possible for the user to have a smoke or the like with the helmet put thereon. Thus, both types of the cap bodies have both merits and demerits.

SUMMARY OF THE INVENTION

Accordingly, it is an object of the present invention to provide a helmet having both advantages of the cap bodies of the above-described two types.

To achieve the above object, according to the present invention, there is provided a helmet for riding a vehicle comprising a cap body which is comprised of a main cap body provided at a front surface thereof with a large window opening opened at a lower edge thereof, and an auxiliary cap body pivotally carried at left and right opposite sidewalls of the main cap body, said auxiliary cap body being turned between a lowered position for covering a lower half of the large window opening so as to make an upper half of the large window opening into a small window opening, and a lifted position for opening the entire large window opening; and a lock mechanism provided between the main and auxiliary cap bodies for automatically locking the auxiliary cap body, when the auxiliary cap body is turned to the lowered position.

With the above construction, when the auxiliary cap body is at the lowered position, the main and auxiliary cap bodies constitute the cap body of the full face type, thereby covering the user by its wide protection area. When the auxiliary cap body is at the lifted position, the entire large window opening of the main cap body is exposed to ensure that the user can have a smoke or eat and drink with the helmet put thereon as in the cap body of the jet type. This is convenient. Moreover, if the auxiliary cap body is turned to the lowered position, it is automatically locked to the main cap body. Therefore, the user need not be concerned whether or not the auxiliary cap body is locked to the main cap body. Further, it is possible to reliably prevent the auxiliary cap body from turning toward the lifted position by a wind pressure, a vibration or the like.

In addition to the above construction, it may be proposed that the lock mechanism includes a lock plate mounted on one of the main and auxiliary cap bodies, a lock pin mounted on the other of the main and auxiliary cap bodies for engaging with the lock plate at the lowered position of the auxiliary cap body, a spring means for biasing the lock pin in a direction to engage the lock plate, and a releasing element mounted on the auxiliary cap body such that the lock pin is disengaged from the lock plate against a biasing force of the spring means, and that a slant is formed on the lock pin for inducing the lock plate into engagement with the lock pin when the auxiliary cap body is turned to the lowered position from the lifted position side. With such construction, the lock mechanism is made simple in structure and reliable in operation.

In addition, if a shield plate is pivotally carried on the auxiliary cap body for opening and closing the small window opening, and a click stop mechanism is provided between the shield plate and the auxiliary cap body for retaining the shield plate at any angled position, it is possible to turn the shield plate along with the auxiliary cap body and therefore, it is unnecessary to manipulate the shield plate, when the auxiliary cap body is to be turned.

Further, it may be proposed that the auxiliary cap body includes a chin covering portion bent to bulge forwardly and a pair of ear portions which extend upwardly from left and right opposite ends of the chin covering portion, said ear portions are pinned on the main cap body, and that the lock mechanism is provided to permit an edge portion of each of the ear portions to lock to the main cap body. If the helmet is constructed in the above manner, it is easy to mount the lock mechanism while avoiding the interference with a pivotal connection of the auxiliary cap body on the main cap body, leading to an increased variation in design of the lock mechanism.

Yet further, it may be proposed that the main cap body includes a pivot detachably secured to left and right outer surfaces thereof, the auxiliary cap body having a boss retained on the pivot, a shield plate is pivotally carried on the boss inside the auxiliary cap body to open and close the small window opening, a control plate is secured at a base end thereof to the auxiliary cap body to clamp the shield plate between the control plate itself and the auxiliary cap body, said control plate penetrated by the pivot, a click stop mechanism is provided between the control plate and the shield plate for retaining the shield plate at any angled position. If the helmet is constructed in the above manner, it is possible to turn the shield plate along with the auxiliary cap body and therefore, it is unnecessary to manipulate the shield plate, when the auxiliary cap body is to be turned, leading to a simple operation.

Yet further, if the control plate is provided with an elasticity for flexing a tip end of the control plate so as to permit the shield plate to slip off from the pivot when the pivot is detached from the main cap body, it is possible to perform the attaching and detaching of the shield plate by an extremely simple operation, which comprises detaching the pivot from the main cap body and flexing the control plate. Accordingly, the replacement of the shield plate by a new one can easily be achieved.

In addition, it may be proposed that the helmet further includes a control plate secured to an inner surface of the auxiliary cap body, and an upper limit restraining means provided between the control plate and the main cap body, said upper limit restraining means comprising a stop arm formed on the control plate and an upper limit stop member fixed on an outer surface of the main cap body, said upper limit stop member is provided with a stop wall for receiving the stop arm to define the lifted position of the auxiliary cap body, and a crest portion over which the stop arm climbs while being resiliently deformed, immediately before the auxiliary cap body reaches the lifted position. With the helmet as mentioned, the upper limit restraining means contributes both to the restraint of the upward movement of the auxiliary cap body and to maintenance of the auxiliary cap body at the lifted position. It is simple in construction and reliable in operation.

Further, if the stop arm is in abutment against the inner surface of said auxiliary cap body so that a resilient deformation is also generated in the auxiliary cap body, when the stop arm climbs over the crest portion, the force to maintain the auxiliary cap body at the lifted position is reinforced by the elastic restoring force of the auxiliary cap body. Therefore, the auxiliary cap body can reliably be kept at the lifted position by a large elastic force.

Yet further, it may be proposed that the upper limit member is fixed on the main cap body at a radial outer location from a position for pivotally carrying the auxiliary cap body on the main cap body, and the lock mechanism is disposed at a location far radially outside of the location of the upper limit stop member. If the helmet is constructed in the above manner, the lock mechanism and the upper limit restraining means for restraining the position of the auxiliary cap body relative to the main cap body can be disposed in a limited space with a good efficiency and without interference with each other.

The above and other objects, features and advantages of the invention will become apparent from the following description of the preferred embodiment taken in conjunction with the accompanying drawings.

DESCRIPTION OF THE PREFERRED EMBODIMENT

The present invention will now be described by way of a preferred embodiment in connection with the accompanying drawings.

Figure 1:
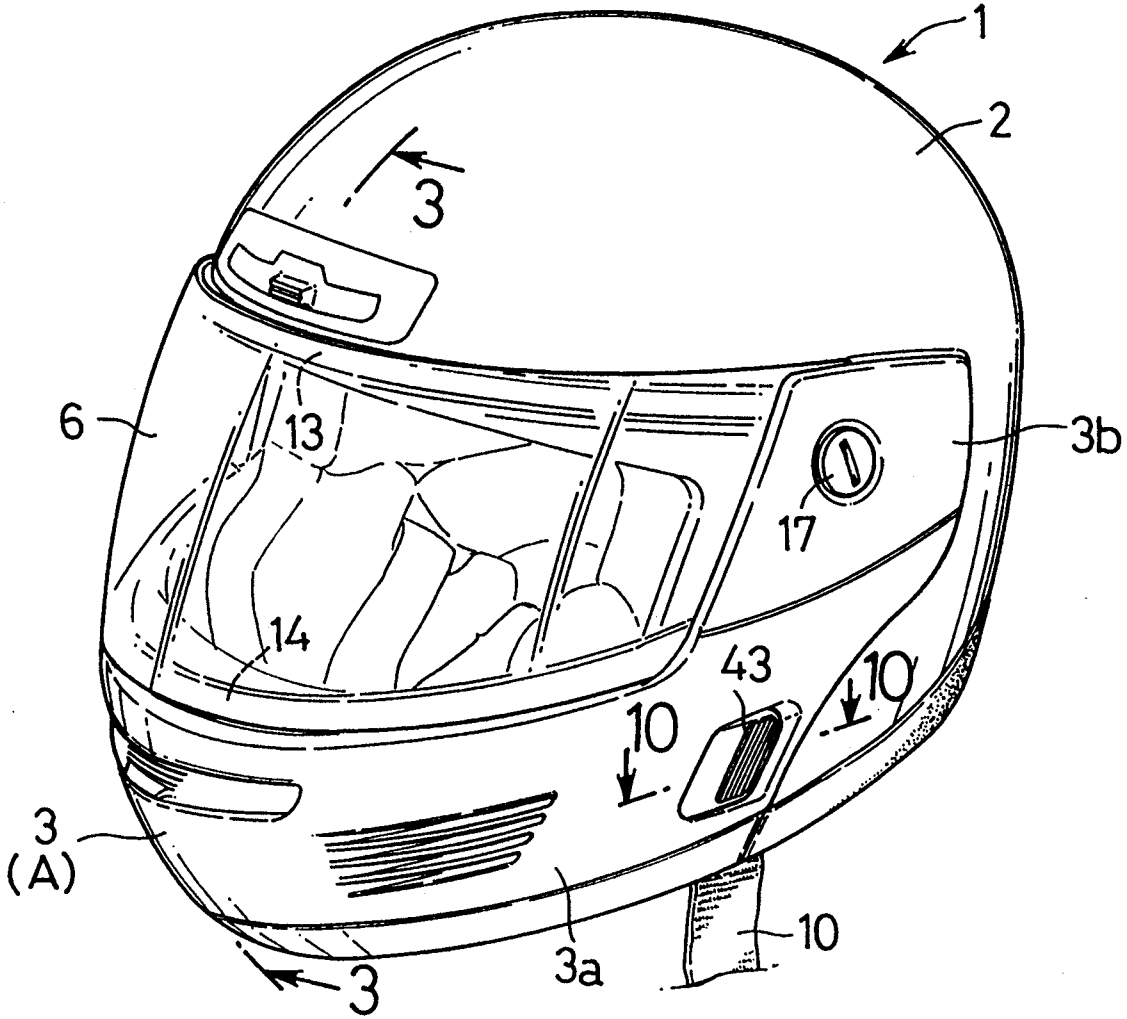
FIG. 1 is a perspective view of a helmet according to a preferred embodiment of the present invention.
Figure 2:
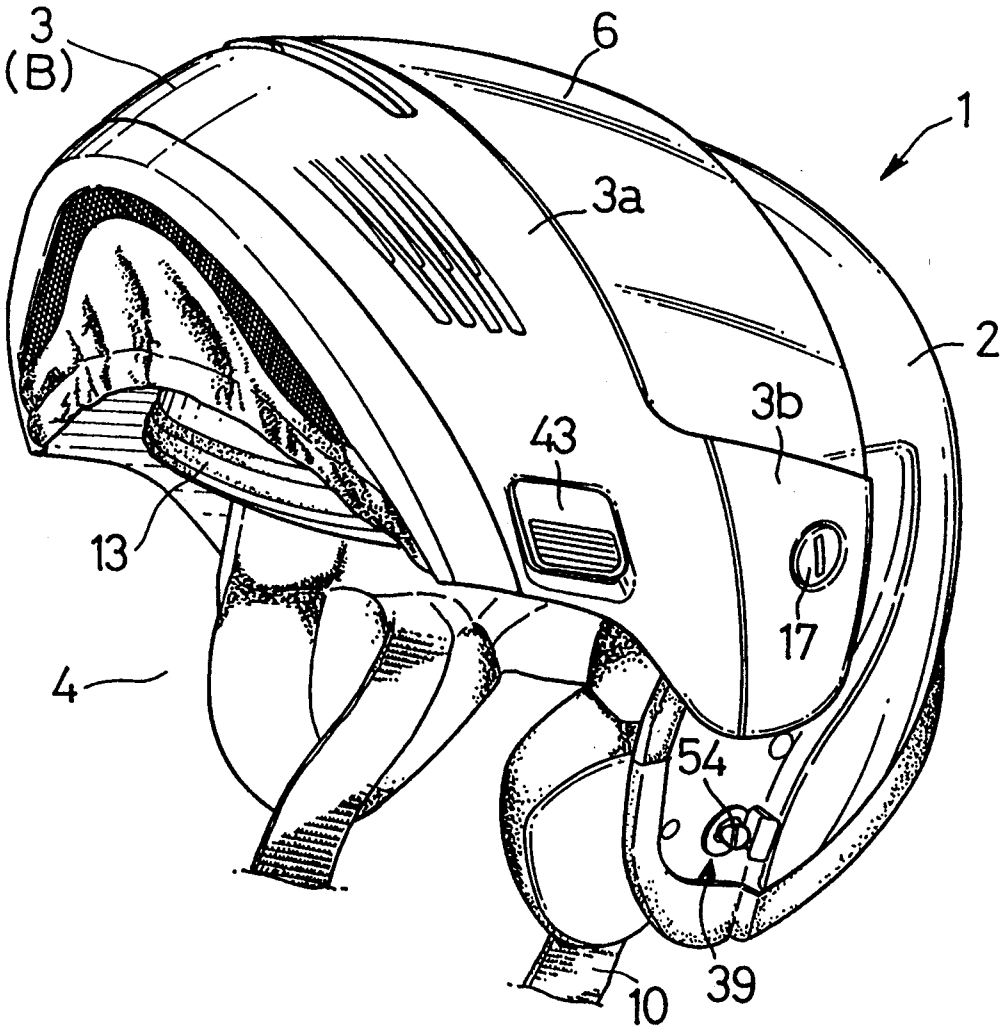
FIG. 2 is a perspective view of the helmet with an auxiliary cap body at a lifted position.

FIGS. 1 and 2 illustrate the entire construction of a helmet for riding a vehicle. A cap body 1 of the helmet is comprised of a main cap body 2 and an auxiliary cap body 3. The main cap body 2 is formed into a cap body of a so-called jet type so as to cover a user's head excluding a face. Therefore, the main cap body 2 has a large window opening 4 in its front wall, which is open at a lower end thereof.

The auxiliary cap body 3 includes a chin-covering portion 3*a* bent to bulge forwardly, and a pair of ear portions 3*b*, 3*b* extending upwardly from left and right opposite ends of the chin-covering portion 3*a* and pinned on left and right sides of the main cap body 2. The auxiliary cap body 3 is turnable between a lowered position A (FIG. 1) and a lifted position B (FIG. 2). Thus, the auxiliary cap body 3 closes a lower half of the large window opening 4 in the main cap body 2 to cover the user's chin by the chin-covering portion 3*a* at the lowered position A, with an upper half of the large window opening 4 left defined as a small window opening 5, and has its chin-covering portion 3*a* shifted above the large window opening 4 to expose the entire large window opening 4 at the lifted position B.

A transparent shield plate 6 is pivotally carried on the auxiliary cap body 3 for vertical turning movement to open and close the small window opening 5.

Figure 3:
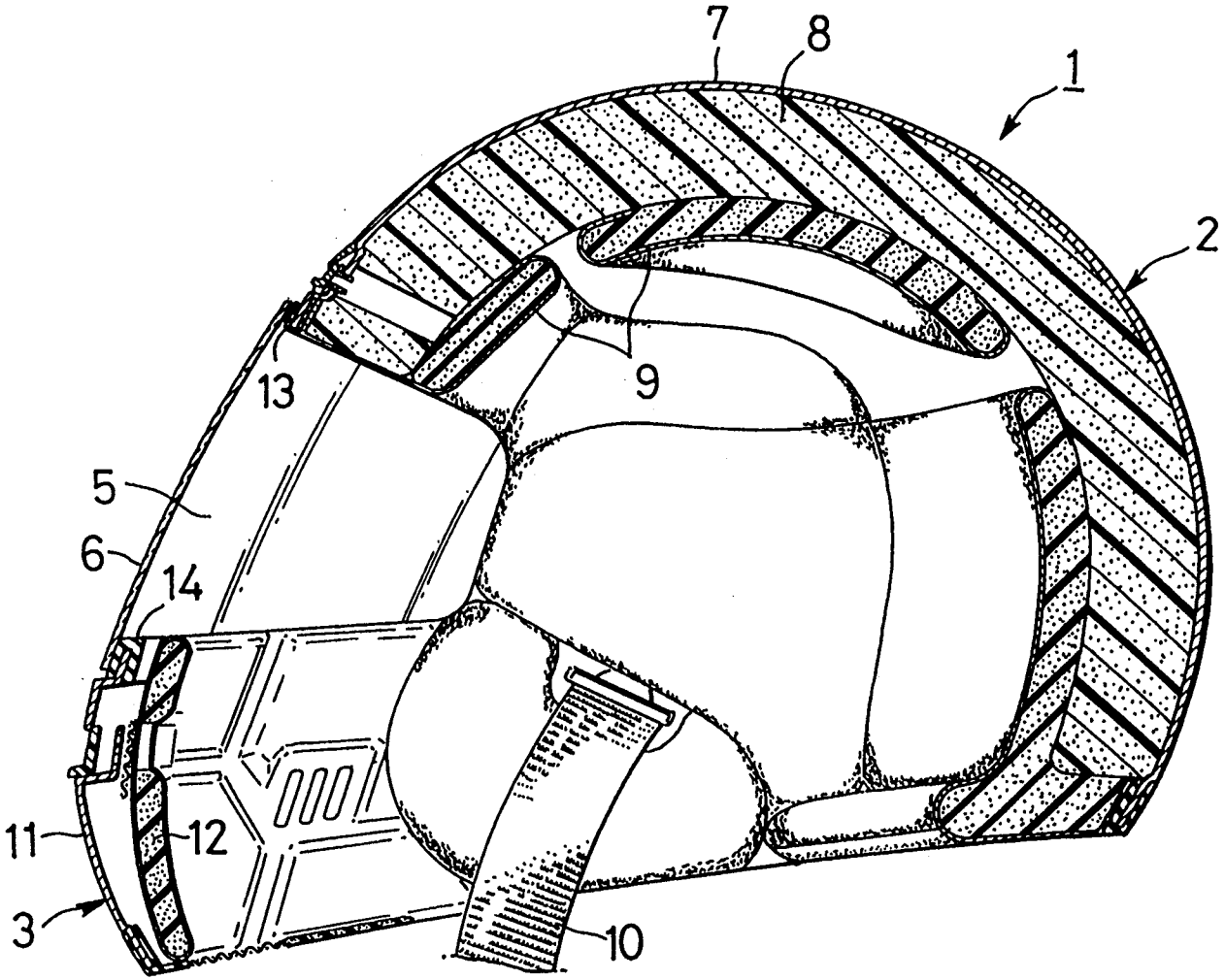
FIG. 3 is a sectional view taken along a line 3—3 in FIG. 1.

FIG. 3 is a longitudinal sectional view of the cap body 1. As shown in FIG. 3, the main cap body 2 is comprised of an FRP shell 7, a shock-absorbing liner 8 of an expanded polystyrene fitted or mounted in the shell 7, and a fit pad 9 of an urethane foam further lined on the liner 8. A chin belt 10 is rivetted at its base end on the shell 7.

The auxiliary cap body 3 is comprised of a shell 11 injection-molded from a synthetic resin, and a liner 12 made essentially of an urethane foam. The liner 12 is lined only on such a portion of the shell 11 which faces the large window opening 4.

A resilient sealing member 13 is adhesively bonded to a lower edge and left and right opposite side edges of the shell 7 of the main cap body 2 at the edge of the small window opening 5, and a resilient sealing member 14 is also adhesively bonded to an upper edge of the shell 11 of the auxiliary cap body 3 at the edge of the small window opening 5, so that the shield plate 6 brings its inner surface into close contact with the sealing members 13 and 14 at the full closing position of the shield plate 6.

FIGS. 4 to 8 and 12 show the mounting structures for mounting the auxiliary cap body 3 and the shield plate 6 on the main cap body 2. The mounting structures are provided symmetrically at left and right opposite ends of the auxiliary cap body 3 and the shield plate 6 and hence, only the mounting structure at the left side will be described.

Figure 4:
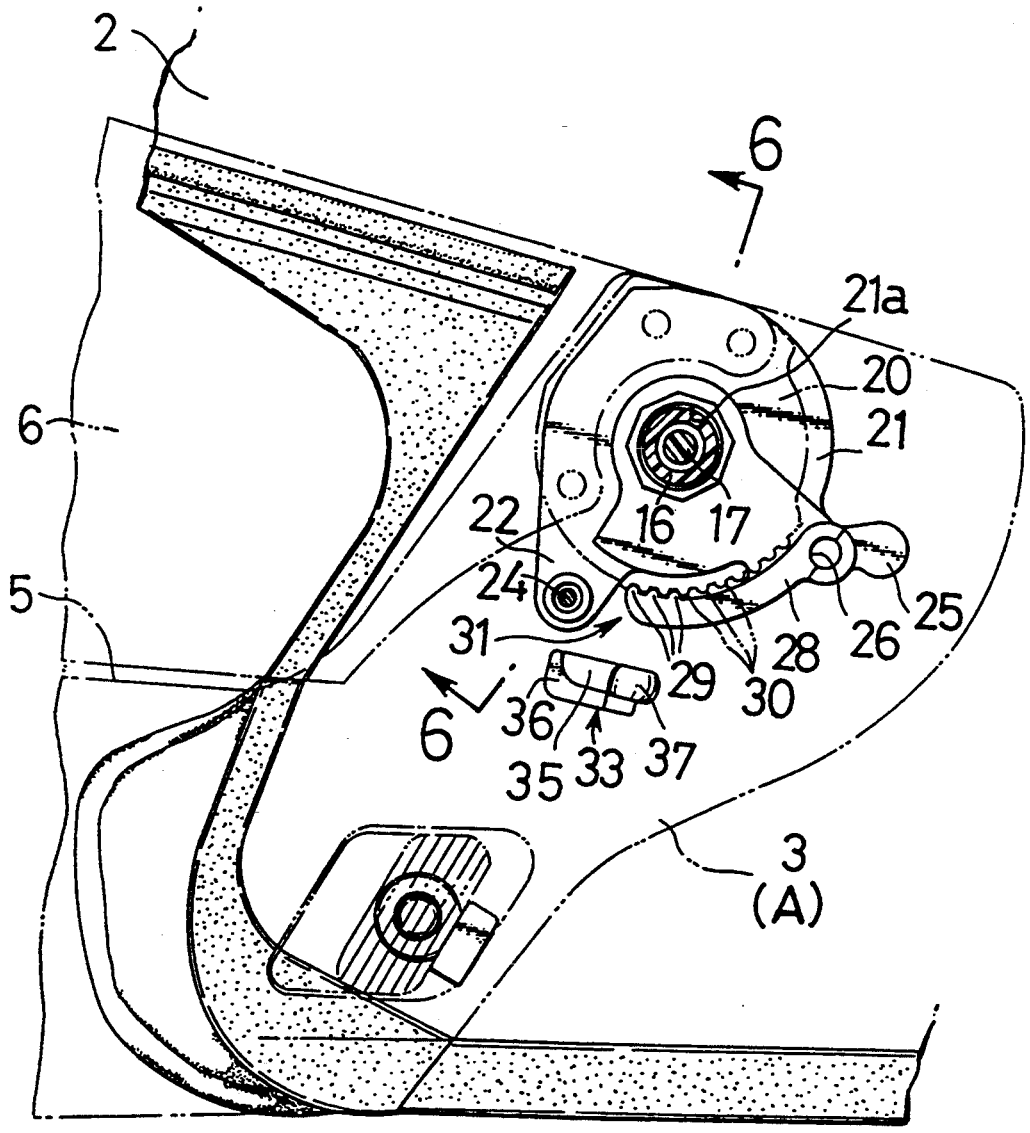
FIG. 4 is a side view of a mounting structure for mounting the auxiliary cap body and a shield plate on a main cap body.
Figure 6:
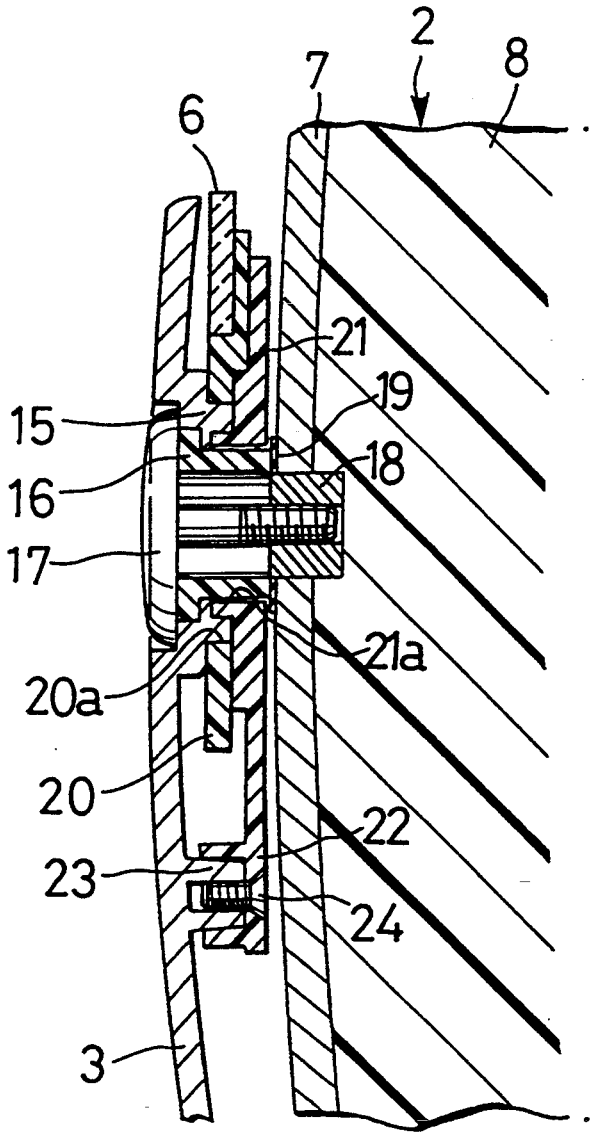
FIG. 6 is a sectional view taken along a line 6—6 in FIG. 4.
Figure 12:
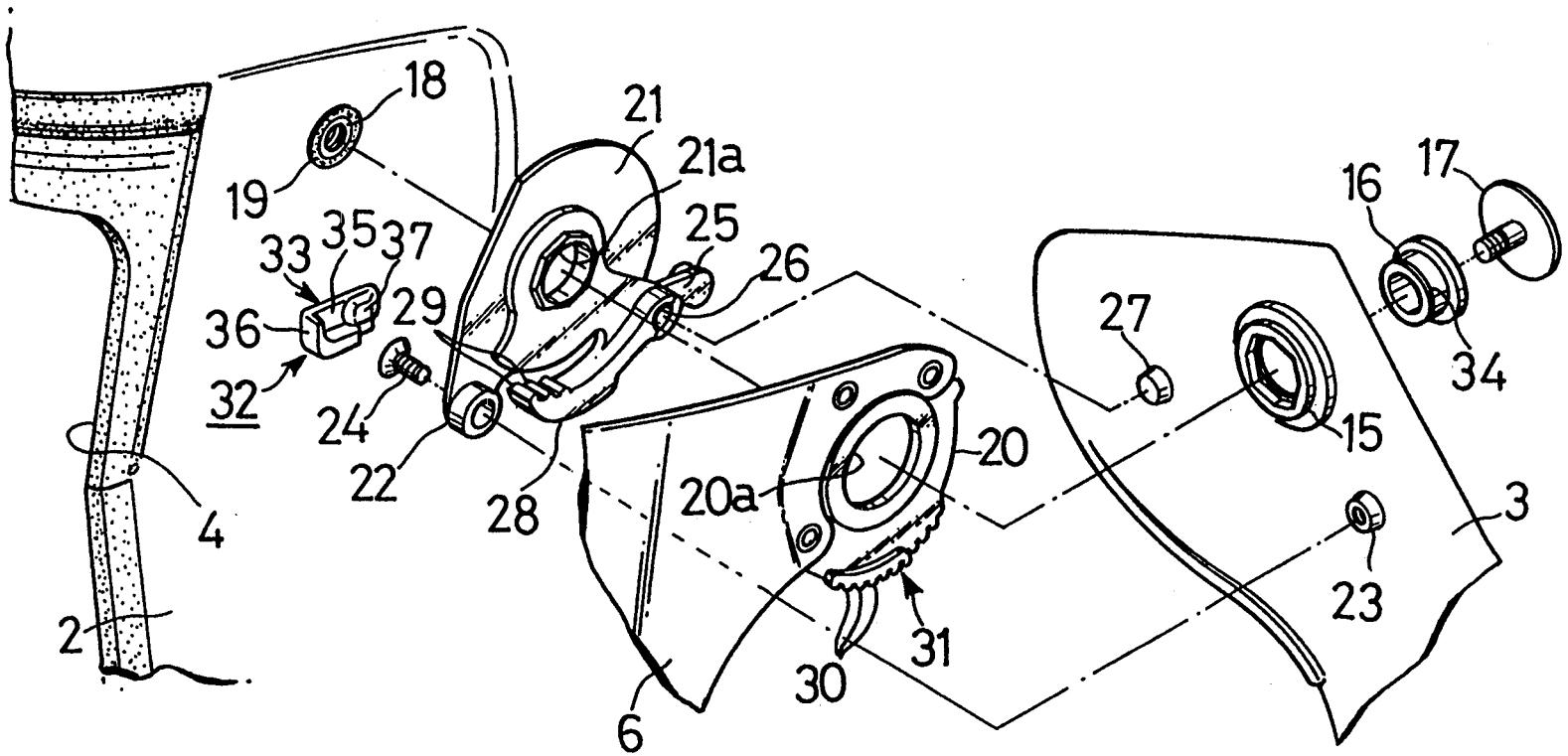
FIG. 12 is an exploded perspective view of the mounting structure.

Referring to FIGS. 4, 6 and 12, a boss 15 is formed on the ear portion 3*b* of the auxiliary cap body 3. A cylindrical pivot 16 is secured to an outer surface of the main cap body 2. The boss 15 is pivotally carried and retained on the pivot 16. The pivot 16 has a hollow through which a machine screw 17 penetrates. The machine screw 17 is screwed into a nut 18 embedded in the main cap body 2. For the purpose of preventing the rotation of the pivot 16, a rubber washer 19 is interposed between the pivot 16 and the outer surface of the main cap body 2. A boss hole 20*a* is provided in a bracket plate 20 rivetted at an end of the shield plate 6. The boss 15 projects inwardly from the inner surface of the auxiliary cap body 3 for fitting into the boss hole 20*a* by the outer peripheral surface of the boss 15. A control plate 21 is pivotally carried at its central hole 21*a* on the pivot 16 inwardly of the bracket plate 20.

The control plate 21 is made from a synthetic resin and includes a mounting arm 22 which projects from a lower end of a front portion thereof. The mounting arm 22 is secured by a machine screw 24 to a mounting boss 23 which projects from an inner surface of the ear portion 3*b* of the auxiliary cap body 3. The control plate 21 also includes a stop arm 25 projecting from a lower end of a rear portion of the plate 21, and a positioning hole 26 opened at an outer surface of the plate 21 in the vicinity of the stop arm 25. A positioning projection 27 is protrudingly provided on an inner surface of the ear portion 3*b* so as to fit into the positioning hole 26. In this manner, the control plate 21 is connected to the auxiliary cap body 3 and clamps the bracket plate 20 in cooperation with the auxiliary cap body 3 with an elastic force of the control plate 21. In addition, a tip end of the stop arm 25 is in contact with an inner surface of the auxiliary cap body 3.

Further, a resilient arm 28 is formed at the lower end of the control plate 21. The arm 28 has a single or a plurality of fixing click tooth or teeth 29 at a free end thereof. The resilient arm 28 is flexible in a radial direction of the pivot 16.

A large number of movable click teeth 30 are formed around an outer periphery of the bracket plate 20 on a circular line about the pivot 16. The fixing click teeth 29 engage the movable click teeth 30 to constitute a click stop mechanism 31 together with the movable click teeth 30. Thus, if the shield plate 6 is vertically turned, the engagement of the fixing and movable click teeth 29 and 30 is shifted as shield plate 6 turns, and the engaging force enables the shield plate 6 to be retained at any angled position.

Figure 9:
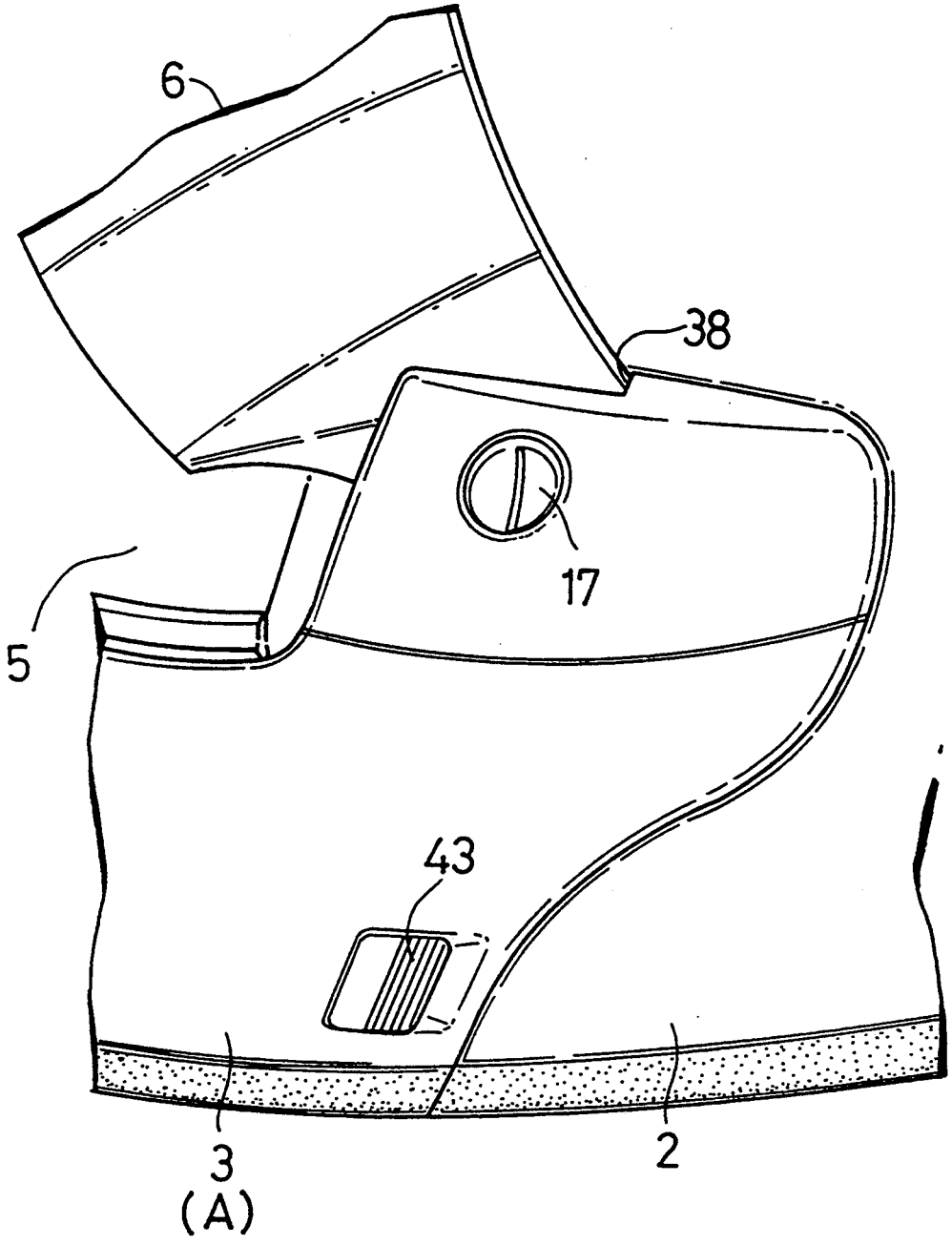
FIG. 9 is a perspective view for explaining a restriction of the full opening of the shield plate.

The full closed position of the shield plate 6 is determined by the contact of the inner surface of the shield plate 6 with the sealing members 13 and 14 on the peripheral edge of the small window opening 5, as described above. The full open position of the shield plate 6 is determined by abutment of the upper edge of the shield plate 6 against a step 38 formed at an upper edge of the ear portion 3*b* of the auxiliary cap body 3, as shown in FIG. 9.

Figure 7:
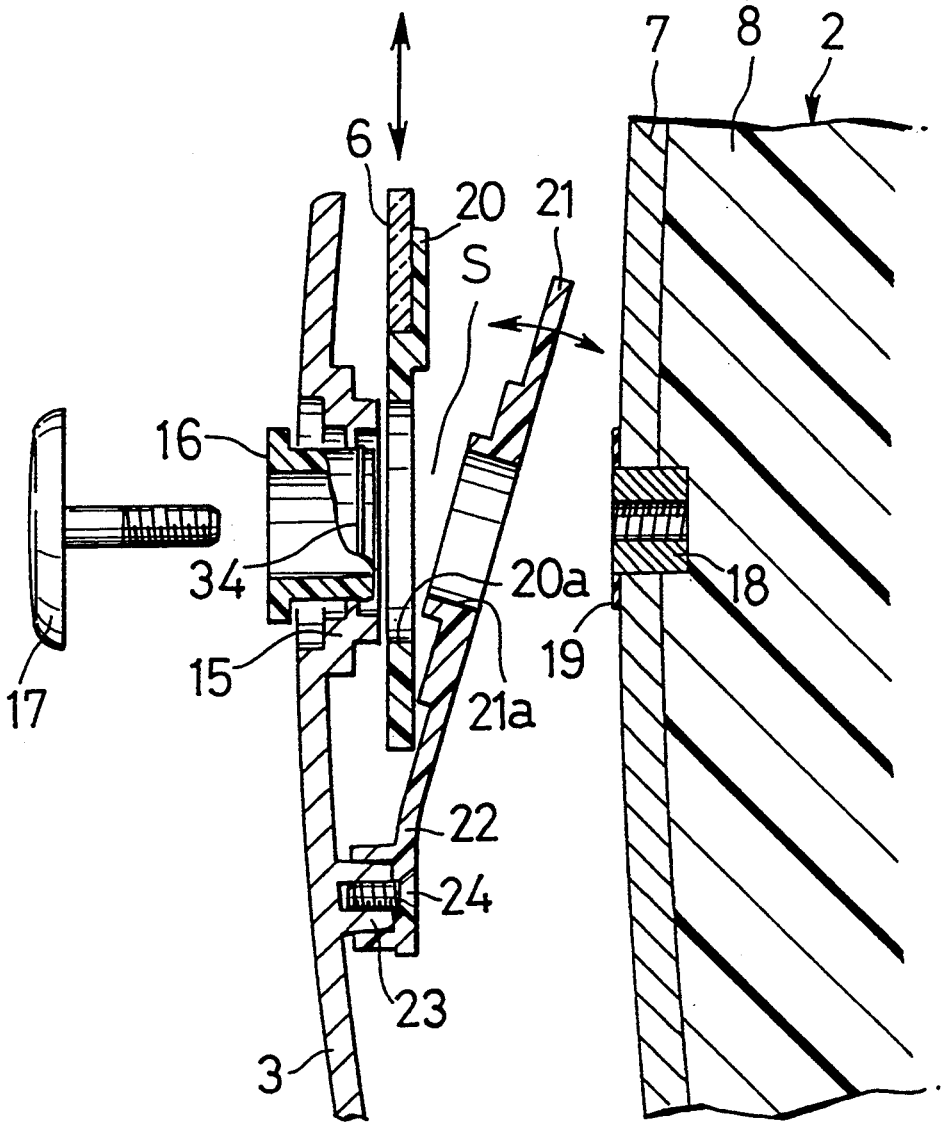
FIG. 7 is a sectional view similar to FIG. 6, explaining an operation of detachment of the shield plate.

In detaching the shield plate 6 for replacement with a new one, as shown in FIG. 7, the operator first removes the machine screw 17 to separate the pivot 16 from the main cap body 2, and then, pulls the control plate 21 away from the pivot 16 toward the main cap body 2 while flexing the mounting arm 22, thereby defining a gap S. The bracket plate 20 may be detached through the gap S from the boss 15 of the auxiliary cap body 3. In order to prevent the pivot 16 from being unreasonably slipped out from the boss 15, a thin rib 34 is formed around an outer periphery of a tip end portion of the pivot 16. This rib 34 deforms to pass the pivot 16 through the hollow of the boss 15, when it is subjected to a force for insertion or removal of the pivot 16 equal to or more than a given value.

Figure 5:
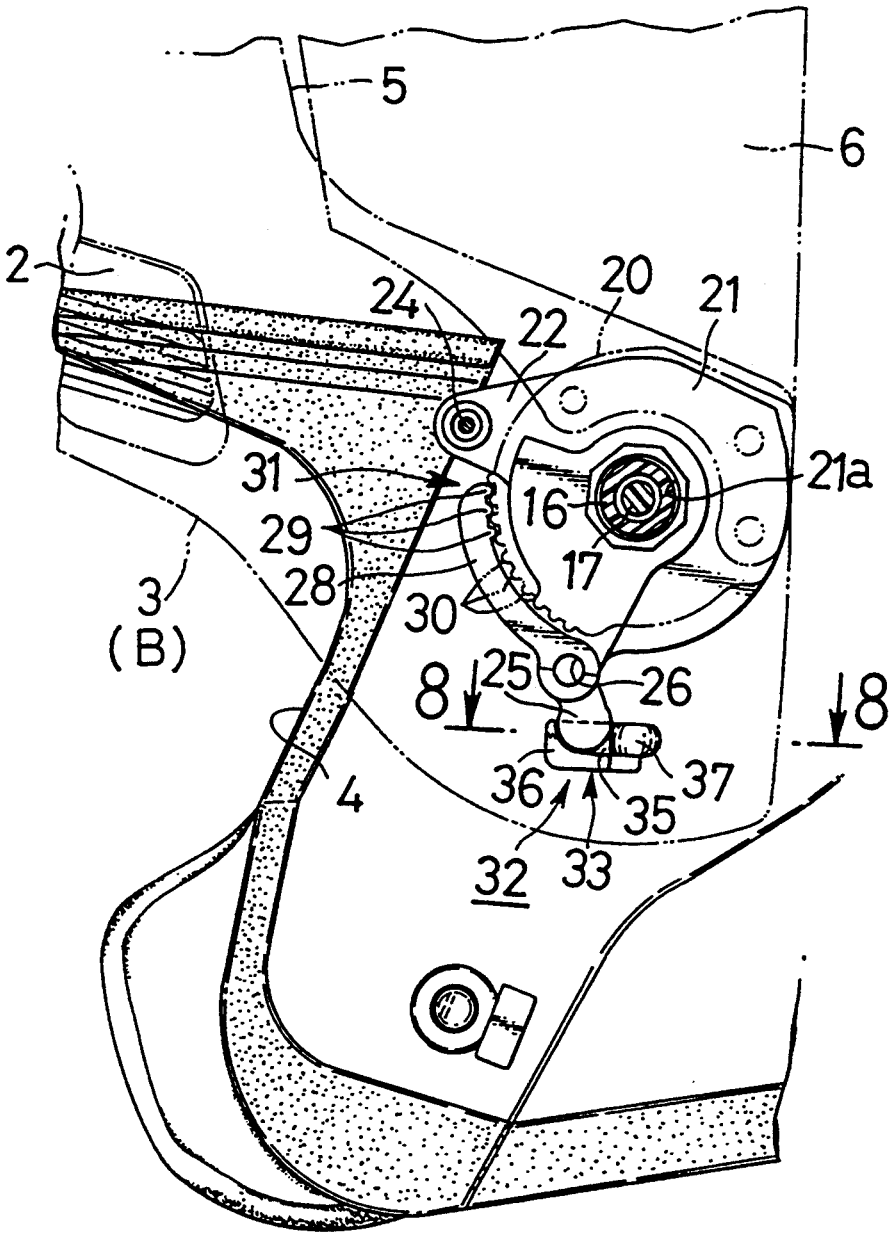
FIG. 5 is a side view similar to FIG. 4, with the auxiliary cap body at the lifted position.
Figure 8:
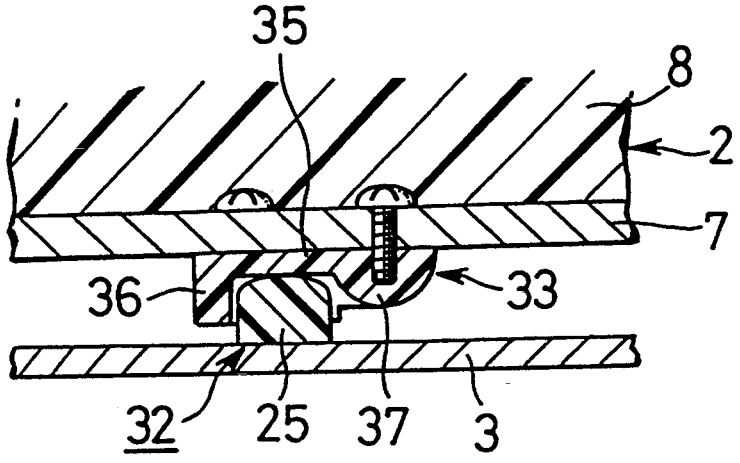
FIG. 8 is a sectional view taken along a line 8—8 in FIG. 5.

Referring to FIGS. 5 and 8, an upper limit stop member 33 is fixedly mounted on the outer surface of the main cap body 2. The stop member 33 constitutes together with the stop arm 25 an upper limit restraining means 32 for defining the lifted position B of the auxiliary cap body 3. The upper limit stop member 33 is comprised of a base portion 35 joined to the outer surface of the main cap body 2, an L-shaped stop wall 36 protruding from the base portion 35 at an area extending from a front edge to a lower edge of the base portion 35, and a crest portion 37 raised on a surface of the base portion 35 at its rear portion. A gap defined between a front wall portion of the stop wall 36 and the crest portion 37 extends at a length enough to accommodate the tip end of the stop arm 25.

Thus, when the auxiliary cap body 3 is turned upwardly from the lowered position A, the control plate 21 is also turned along with the auxiliary cap body 3. Just before the lifted position B, the stop arm 25 of the control plate 21 starts to climb the crest portion 37 of the upper limit stop member 33 while being slightly flexed outwardly along with the auxiliary cap body 3 which is in contact with the stop arm 25. Having climbed over the crest portion 37, the stop arm 25 is immediately received on the front wall portion of the stop wall 36, as shown in FIG. 5, so that the lifted position B of the auxiliary cap body 3 is defined. Thus, the auxiliary cap body 3 is maintained at the lifted position B by a resistance to the climbing of the stop arm 25 over the crest portion 37, i.e., an elastic restoring force of the stop arm 25 and the auxiliary cap body 3. Accordingly, if the auxiliary cap body 3 is turned downwardly by an operating force larger than the resistance to the climbing, the stop arm 25 climbs again over the crest portion 37 in the opposite direction while being flexed along with the auxiliary cap body 3.

Figure 10:
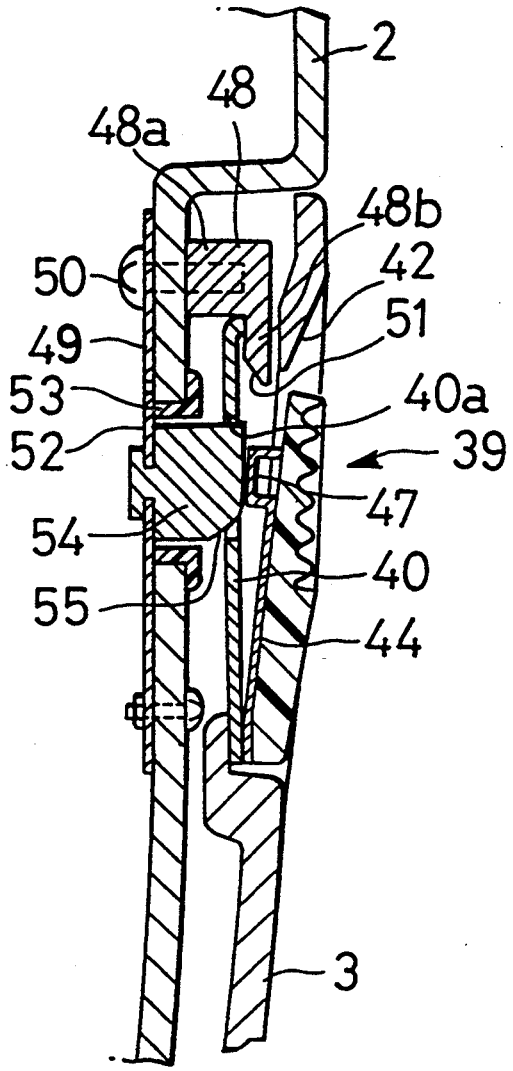
FIG. 10 is a sectional view taken along a line 10—10 in FIG. 1.
Figure 11:
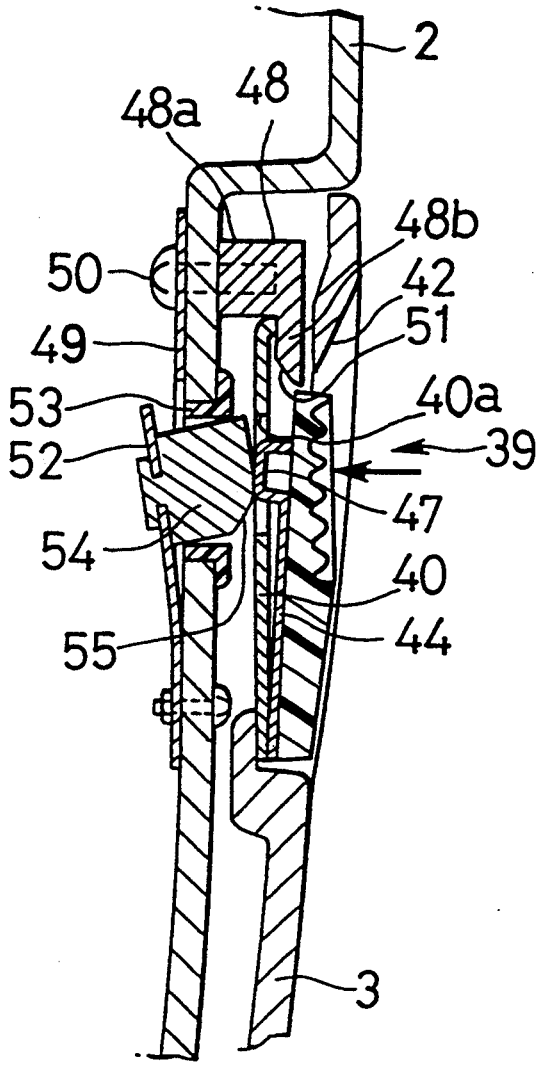
FIG. 11 is a sectional view similar to FIG. 10, explaining an operation of unlocking of the auxiliary cap body from the main cap body.
Figure 13:
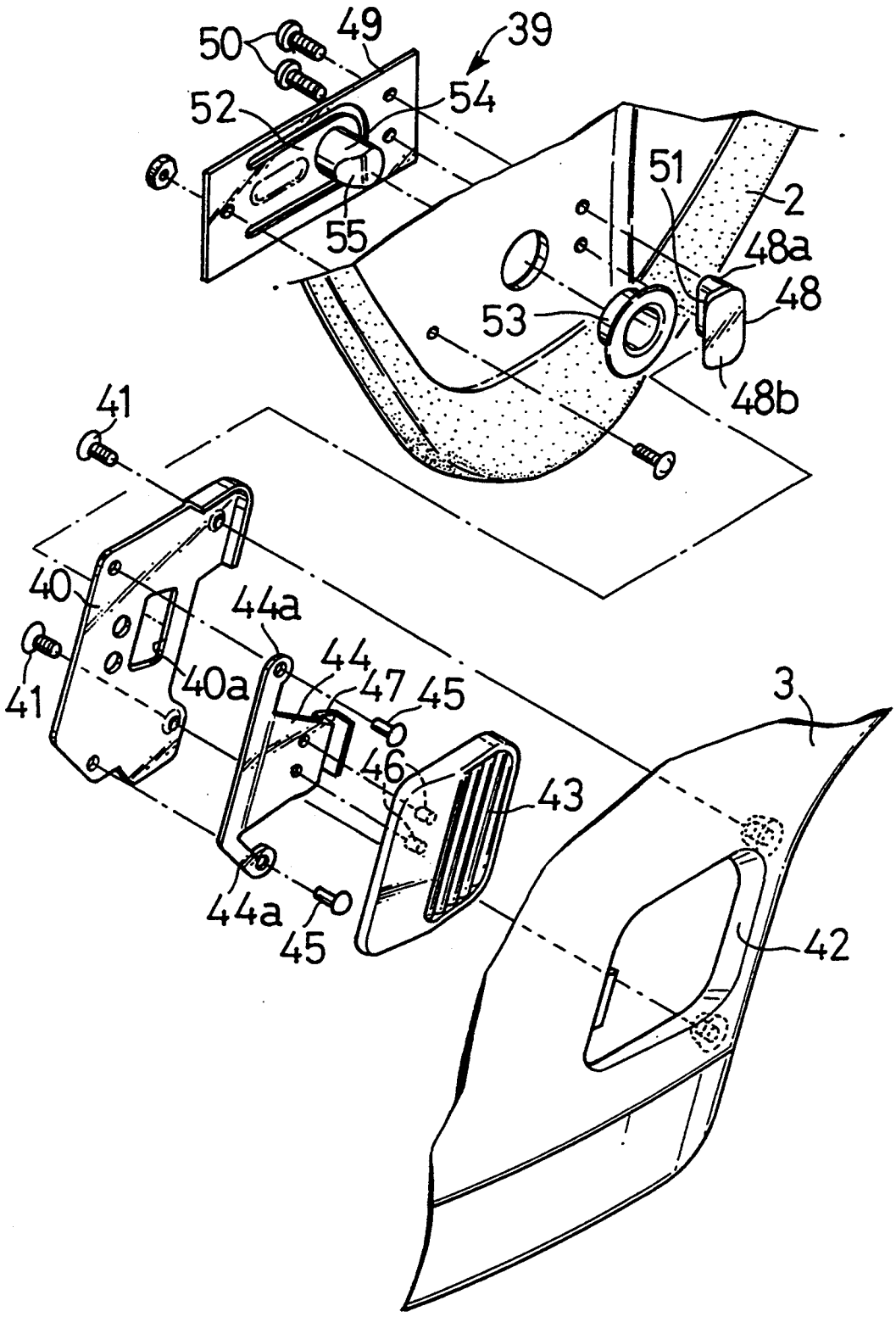
FIG. 13 is an exploded perspective view of a lock mechanism for locking the auxiliary cap body to the main cap body.

FIGS. 10, 11 and 13 show a lock mechanism 39 for locking the auxiliary cap body 3 at the lowered position A. As shown in these figures, the left and right ends of the chin covering portion 3*a* are opposed to the outer surface of the main cap body 2 at the lowered position A of the auxiliary cap body 3. And a lock plate 40 is secured to an inner surfaces of that left and right ends. The lock plate 40 has a square lock hole 40*a* at its central portion. A release key 43 is accommodated in a release key accommodating hole 42 in the auxiliary cap body 3 and connected to the lock plate 40 through a leaf spring 44. More specifically, mounting pieces 44*a* are formed at a base end of the leaf spring 44 and rivets 45 secure the mounting pieces 44*a* to the lock plate 40. The release key 43 is secured to a tip end of the leaf spring 44 by projections 46 integral with the release key 43. A bent portion 47 is formed at the tip end of the leaf spring 44. The bent portion 47 can protrude into the lock hole 40*a* when applying an urging force to the release key 43.

A lower limit stop member 48 is secured to the outer surface of the main cap body 2 at the left and right sides thereof by machine screws 50. The machine screws 50 also secure together a base plate 49 which is joined to the inner surface of the main cap body 2. The lower limit stop member 48 includes a stand portion 48*a* which stands on the outer surface of the main cap body 2, and a guide portion 48*b* bent forwardly from the tip end of the stand portion 48*a*. The guide portion 48*b* has a slant 51 at its tip end for guiding a rear end of the lock plate 40 toward the stand portion 48*a* during turning movement of the auxiliary cap body 3 towards the lowered position A.

A leaf spring 52 is integrally connected to the base plate 49. The leaf spring 52 has a tip end to which a lock pin 54 is fixedly mounted. The lock pin 54 is capable of fitting into the lock hole 40*a* while passing through a sleeve 53 which is fitted in a sidewall of the main cap body 2. The lock pin 54 is biased by a resilient force of the leaf spring 52 to project a tip end from a base end face of the sleeve 53. A slant 55 is formed on the lock pin 54 at the tip end for permitting the rear end of the lock plate 40 to slide by during turning of the auxiliary cap body 3 towards the lowered position B.

Thus, when the auxiliary cap body 3 is turned downwardly from the lifted position B toward the lowered position A, the rear end of the lock plate 40 is allowed to slide on the slant 55 of the lock pin 54, thereby causing the pin 54 to sink into the sleeve 53. The auxiliary cap body 3 is turned till the rear end of the lock plate 40 is brought into abutment against the stand portion 48*a* of the lower stop member 48, thereby defining the lowered position A of the auxiliary cap body 3. At this time, the lock hole 40*a* and the lock pin 54 are aligned with each other, so that the lock pin 54 will fit into the lock hole 40*a* by the resilient force of the leaf spring 52. At last the auxiliary cap body 3 is locked at its lowered position A. Accordingly, during driving the vehicle, the auxiliary cap body 3 cannot be unreasonably turned upwardly by a wind pressure, a vibration or the like. In such a condition, the auxiliary cap body 3 constitutes together with the main cap body 2 the cap body of the full-face type for protecting even the user's chin.

If the release key 43 is then urged inwardly, the projection 47 urges the tip end of the lock pin 54 against the resilient force of the leaf spring 52 to withdraw the lock pin 54 out of the lock hole 40*a*, so that the lock mechanism 39 is brought into an unlock state. Thus, in this condition, the auxiliary cap body 3 can be turned upwardly. If the auxiliary cap body 3 is retained at the lifted position B by the upper limit stop member 33 in the above-described manner, the entire large window opening 4 in the main cap body 2 is opened, so that the user can have a smoke, eat and drink with the helmet put thereon. The auxiliary cap body 3 cannot be an obstruction. At this time, the shield plate 6 is related to the auxiliary cap body 3 through the click stop mechanism 31 and hence, the shield plate 6 can be turned along with the auxiliary cap body 3, and it is not necessary for the user to lay his or her hand on the shield plate 6. Of course, it is not necessary to manipulate the shield plate 6, even when he or she intends to return the auxiliary cap body 3 to the lowered position A.

What is claimed is:

1. A helmet for riding a vehicle comprising:

a cap body which is comprised of a main cap body provided at a front surface thereof with a large window opening opened at a lower edge thereof, and an auxiliary cap body pivotally connected at left and right opposite sidewalls of the main cap body;

said auxiliary cap body being pivotable between a lowered position for covering a lower half of the large window opening so as to make an upper half of the large window opening serve as a small window opening, and a lifted position for opening the entire large window opening;

a lock mechanism provided between the main and auxiliary cap bodies for automatically locking the auxiliary cap body, when the auxiliary cap body is pivoted to the lowered position;

wherein said lock mechanism comprises a lock plate mounted on one of the main and auxiliary cap bodies, a lock pin mounted on the other of the main and auxiliary cap bodies for engaging with said lock plate at the lowered position of the auxiliary cap body, a spring means for biasing the lock pin in a direction to engage the lock plate, and a releasing element mounted on the auxiliary cap body such that the lock pin is disengaged from the lock plate against a biasing force of the spring means, said lock pin being provided with a slant for inducing the lock plate into engagement with the lock pin when the auxiliary cap body is pivoted toward the lowered position.

2. A helmet for riding a vehicle according to claim 1, further including a shield plate pivotally carried on the auxiliary cap body for opening and closing the small window opening, and a click stop mechanism for retaining said shield plate at any angled position, said shield plate being coupled to the auxiliary cap body through said click stop mechanism.

3. A helmet for riding a vehicle according to claim 1, wherein said auxiliary cap body is comprised of a chin covering portion curved to expand forwardly, and a pair of ear portions which extend upwardly from left and right opposite ends of the chin covering portion and are each connected by a pivotal support on the main cap body, and said lock mechanism is disposed about said pivotal support to lock said pair of ear portions on the main cap body.

4. A helmet for riding a vehicle comprising:

a cap body which is comprised of a main cap body provided at a front surface thereof with a large window opening opened at a lower edge thereof, and an auxiliary cap body pivotally connected at left and right opposite sidewalls of the main cap body;

said auxiliary cap body being pivotable between a lowered position for covering a lower half of the large window opening so as to make an upper half of the large window opening serve as a small window opening, and a lifted position for opening the entire large window opening;

a lock mechanism provided between the main and auxiliary cap bodies for automatically locking the auxiliary cap body, when the auxiliary cap body is pivoted to the lowered position;

wherein said main cap body includes a pivot detachably secured to each of left and right outer surfaces thereof, said auxiliary cap body having a boss retained on each pivot, and said helmet further includes;

a shield plate pivotally carried on the boss inside the auxiliary cap body to open and close the small window opening;

a control plate secured at one end thereof to the auxiliary cap body to clamp the shield plate between the control plate itself and the auxiliary cap body, said control plate penetrated by the pivot; and a click stop mechanism provided between the control plate and the shield plate for retaining the shield plate at any angled position; wherein said control plate is provided with elasticity for flexing the control plate from a side of its other end so as to disengage the shield plate to slip off from the pivot when the pivot is detached from the main cap body.

5. A helmet for riding a vehicle comprising:

a cap body which is comprised of a main cap body provided at a front surface thereof with a large window opening opened at a lower edge thereof, and an auxiliary cap body pivotally connected at left and right opposite sidewalls of the main cap body;

said auxiliary cap body being pitovable between a lowered position for covering a lower half of the large window opening so as to make an upper half of the large window opening serve as a small window opening, and a lifted position for opening the entire large window opening;

a lock mechanism provided between the main and auxiliary cap bodies for automatically locking the auxiliary cap body, when the auxiliary cap body is pivoted to the lowered position;

a control plate secured to an inner surface of the auxiliary cap body; and an upper limit restraining means provided between the control plate and the main cap body, said upper limit restraining means comprising a stop arm formed on the control plate and an upper limit stop member fixed on an outer surface of the main cap body; wherein said upper limit stop member is provided with a stop wall for receiving said stop arm to restrain the lifted position of the auxiliary cap body, and a crest portion over which the stop arm climbs while being resiliently deformed, immediately before the auxiliary cap body reaches the lifted position.

6. A helmet for riding a vehicle according to claim 5, wherein said stop arm is in abutment against the inner surface of said auxiliary cap body so that a resilient deformation is also generated in said auxiliary cap body, when said stop arm climbs over said crest portion.

7. A helmet for riding a vehicle according to claim 5 or 6, wherein said upper limit member is provided on the main cap body at a position separated radially from a position where said auxiliary cap body is pivotally carried on said main cap body, and said lock mechanism is disposed at a position further separated radially than the position of the upper limit stop member.

* * * * *